US008075349B2

(12) United States Patent
Du

(10) Patent No.: US 8,075,349 B2
(45) Date of Patent: Dec. 13, 2011

(54) CIRCUIT BOARD CONNECTOR AND CONNECTOR ASSEMBLY

(75) Inventor: Liang Du, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/815,221

(22) Filed: Jun. 14, 2010

(65) Prior Publication Data

US 2011/0151727 A1 Jun. 23, 2011

(30) Foreign Application Priority Data

Dec. 21, 2009 (CN) ..... 2009 2 0318000 U

(51) Int. Cl.
*H01R 13/64* (2006.01)

(52) U.S. Cl. ..... 439/677; 439/78

(58) Field of Classification Search ..... 439/74, 439/75, 78, 677

See application file for complete search history.

(56) References Cited

U.S. PATENT DOCUMENTS 6,589,074 B1 * 7/2003 Wu ..... 439/540.1
2006/0216960 A1 * 9/2006 Chang ..... 439/74

* cited by examiner

*Primary Examiner* — Ross Gushi
(74) *Attorney, Agent, or Firm* — Altis Law Group, Inc.

(57) ABSTRACT

A circuit board connector includes a main body, first pins, and second pins. The main body is configured to be electrical connection to a circuit board and defines securing holes. Each first pin is straight. Each second pin is bent. The first pins and the second pins are secured in the securing holes.

2 Claims, 4 Drawing Sheets

CIRCUIT BOARD CONNECTOR AND CONNECTOR ASSEMBLY

BACKGROUND

1. Technical Field

The present disclosure relates to a circuit board connector capable of connecting with a fan connector and a circuit board connecter and a connector assembly.

2. Description of Related Art

A fan is used in a computer system for cooling electronic elements. The fan is electronically connected to a motherboard by a fan connector engaging with a circuit board connector. The fan connector defines a plurality of receiving holes, and a plurality of pins is disposed on the circuit board. The receiving holes define a line and receive the pins. However, the fan connector is often engaged with the circuit board in an improper direction.

BRIEF DESCRIPTION OF THE DRAWINGS

Many aspects of the embodiments can be better understood with references to the following drawings. The components in the drawings are not necessarily drawn to scale, and the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
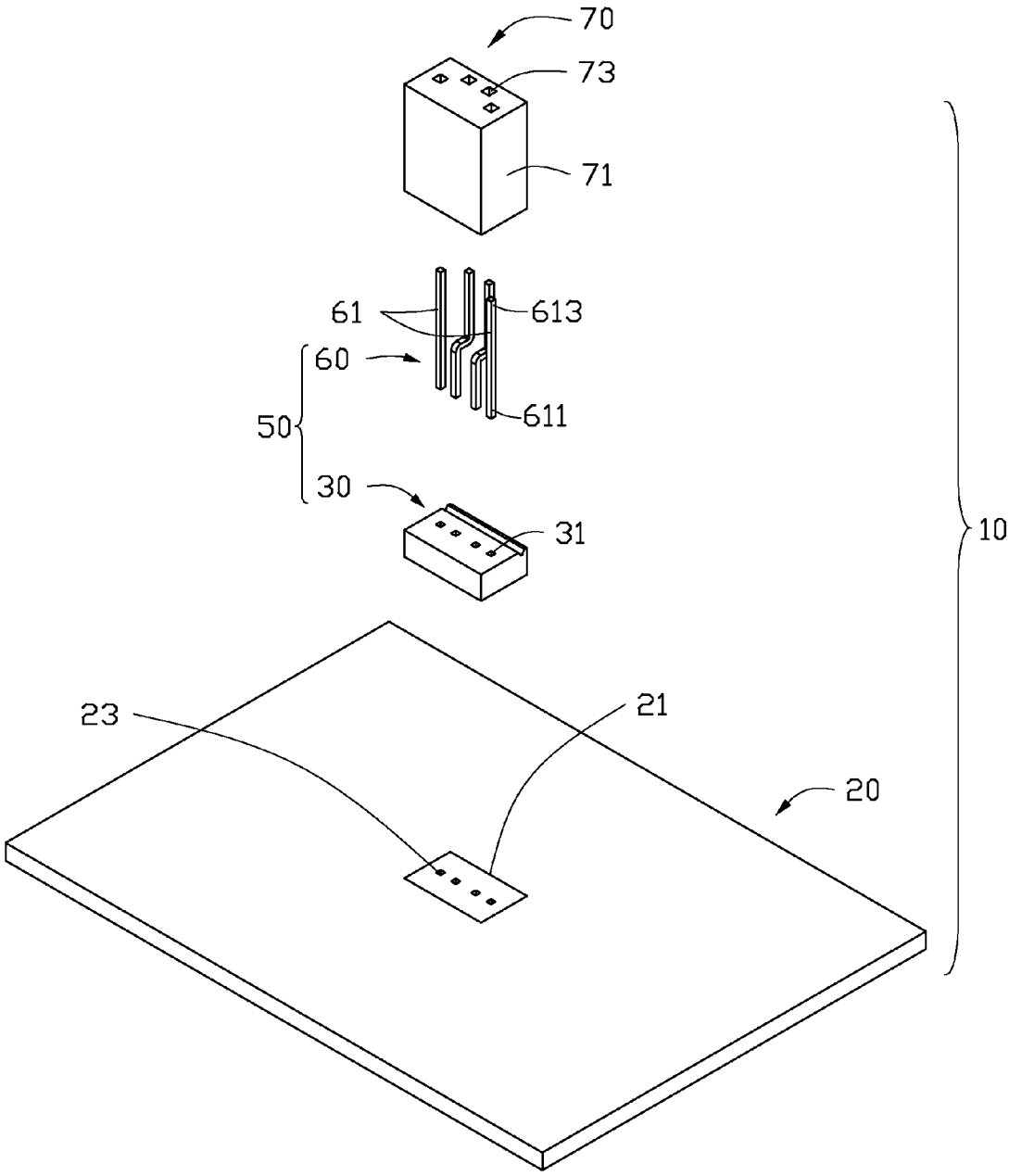
FIG. 1 is an exploded view of a connector assembly in accordance with one embodiment.

Referring to FIG. 1, a connector assembly 10 in accordance one embodiment includes a circuit board 20, a circuit board connector 50, and a fan connector 70.

The circuit board 20 has a connector soldering pad 21. A plurality of through holes 23 is defined in the connector soldering pad 21 and defines one line. In one embodiment, the number of the through holes 23 is four.

Figure 2:
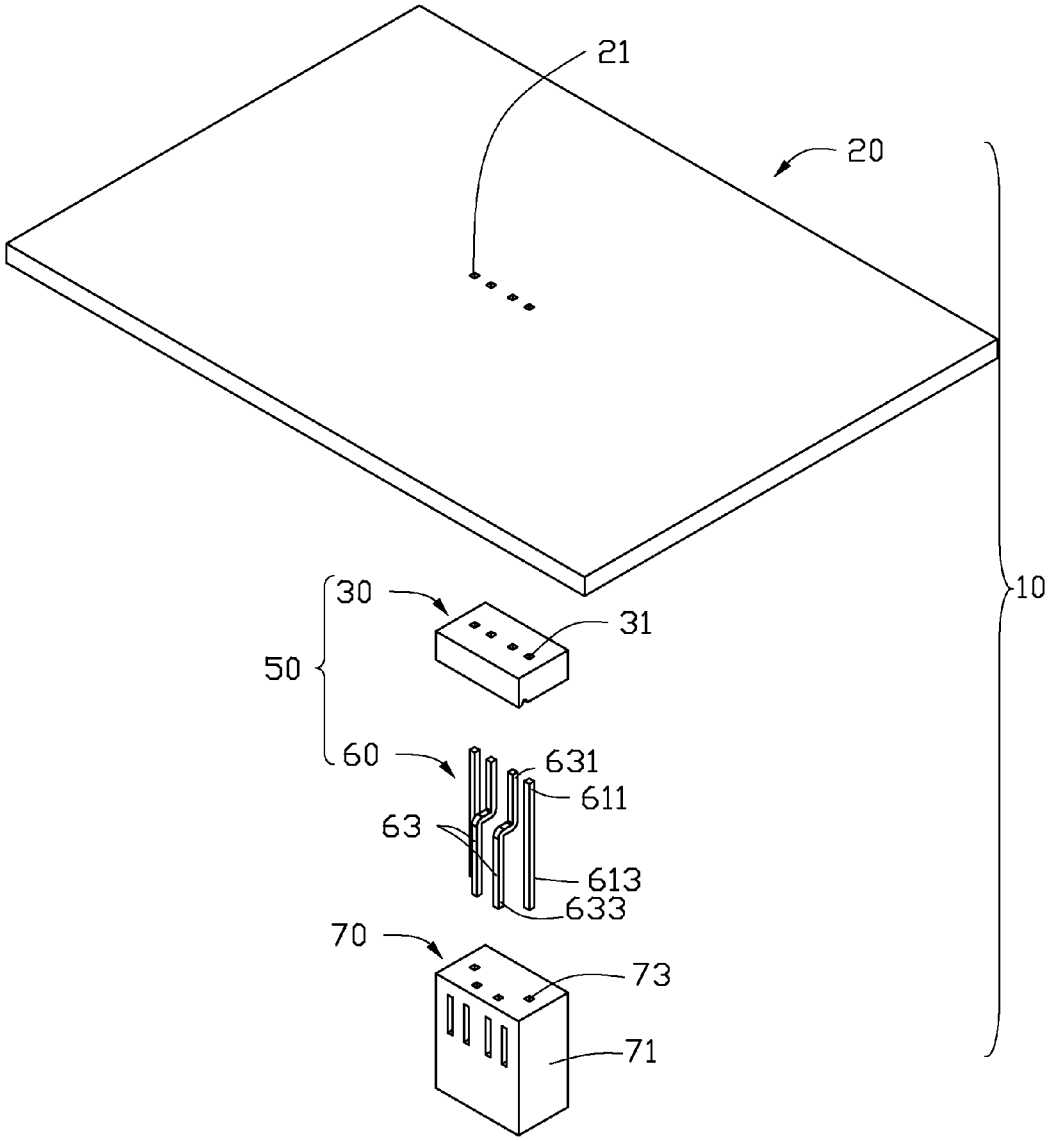
FIG. 2 is similar to FIG. 1, but viewed from a different aspect.

The circuit board connector 50 includes a main body 30 and a pin assembly 60. The main body 30 is shaped to attach to the circuit board 20 in the connector soldering pad 21. A plurality of securing holes 31 is defined in the main body 30 and defines in one line. In one embodiment, the number of the securing holes 31 is four. Referring to FIGS. 1-2, the pin assembly 60 includes a plurality of first pins 61 and a plurality of second pins 63. Each first pin 61 is straight and includes a first end 611 and a second end 613. Each second pin 63 is bent and includes a third end 631 and a fourth end 633. The finished length of each first pin 61 is equal to the length of each second pin 63. In one embodiment, the number of the first pins 61 is two, and the number of the second pins 63 is two.

Figure 3:
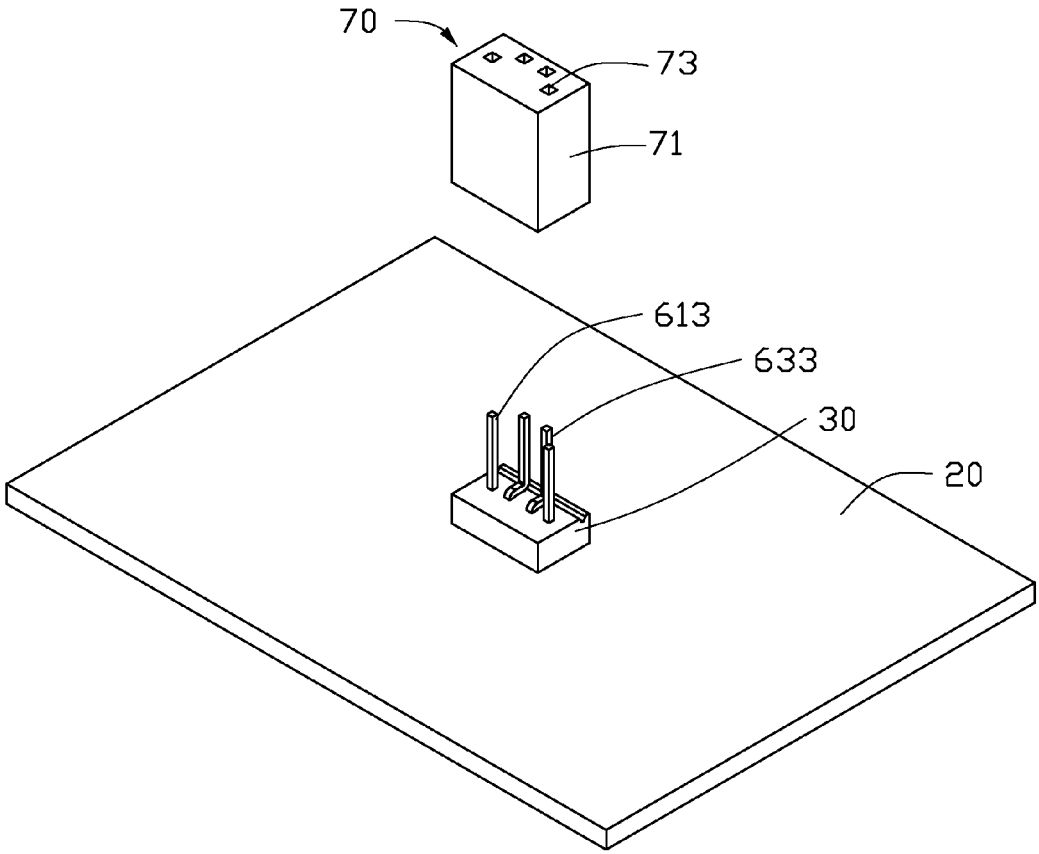
FIG. 3 is a partly assembled view of the connector assembly of FIG. 1.

Referring also to FIG. 3, the first ends 611 of the first pins 61 and the third ends 631 of the second pins 63 are inserted into the securing holes 31 of the main body 30. The first and second pins 61, 63 are engaged into the through holes 23 and soldered on the circuit board 20 in the connector soldering pad 21. Thus, the circuit board connector 50 is secured to and connected to the power supply of the circuit board 20. The second ends 613 of the first pins 61 define a first line, and the fourth ends 633 of the second pins 63 define a second line parallel to the first line.

The fan connector 70 is connected to a fan 90 (shown in FIG. 4) through the base portion 71. For example, the fan connector 70 is connected to the fan 90 by a cable. The base portion 71 is shaped to match with the circuit board connector 50. A plurality of receiving holes 73 is defined in the base portion 71, configured for receiving the first pins 61 and the second pins 63. A shape outlined by the receiving holes 73 is the same shape as the enclosed second ends 613 of the first pins 61 and the fourth ends 633 of the second pins 63. In one embodiment, the number of the receiving holes 73 is four.

Figure 4:
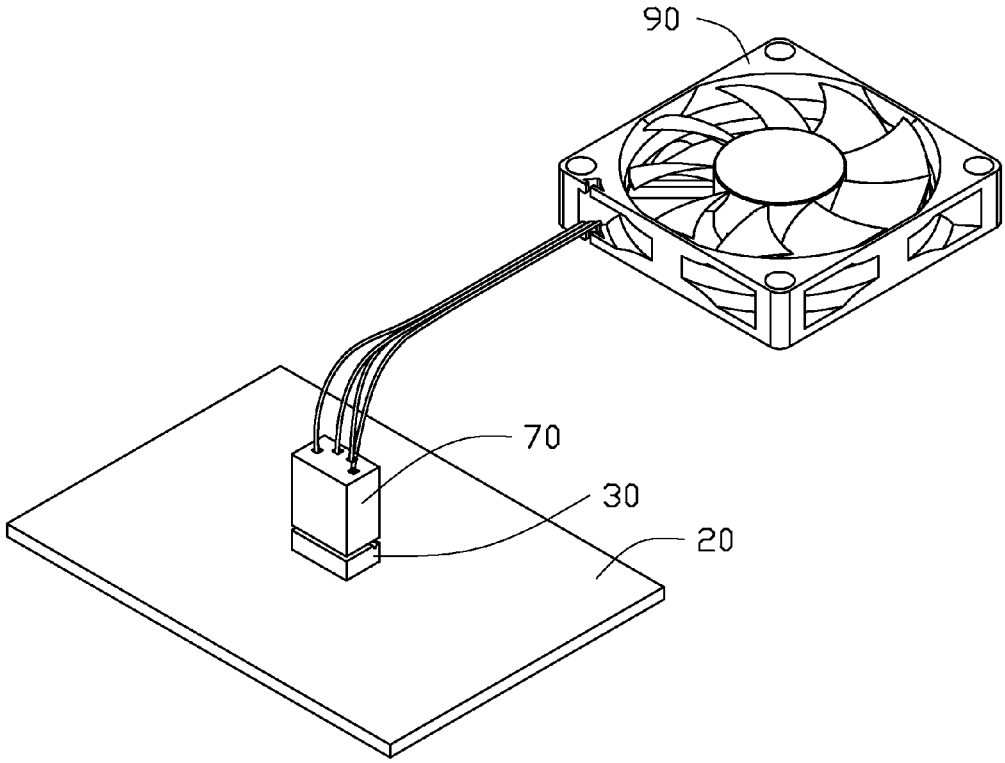
FIG. 4 is an assembled view of the connector assembly of FIG. 1, and shows the fan connector connecting with a fan.

Referring also to FIG. 4, in use, the second ends 613 of the first pins 61 and the fourth ends 633 of the second pins 63 are inserted into the receiving holes 73, to electronically connect the fan 90 to the circuit board 20.

In one embodiment, the shape outlined by the projections of the second ends 613 of the first pins 61 and the fourth ends 633 of the second pins 63 on the circuit board 20 can be trapezoid. In addition, the shape outlined by the projections of the second ends 613 of the first pins 61 and the fourth ends 633 of the second pins 63 on the circuit board 20 can be wave-shaped, or other shape to prevent the fan connector 70 from engaging with the circuit board connector 50 in an improper direction.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A circuit board connector comprising:

a main body configured to be electrically connected to a circuit board, the main body defining a plurality of securing holes;

a plurality of first pins, each first pin being straight and comprising a first end and a second end; and a plurality of second pins, each second pin being bent and comprising a third end and a fourth end;

wherein the first ends and the third ends are engaged in the plurality of securing holes and electronically connected with the circuit board, and the second ends and the fourth ends are secured to a fan connector;

wherein the plurality of securing holes are defined in one line, the length of each first pin is equal to the length of each second pin, and a shape outlined by the projections of the second ends of the first pins and the fourth ends of the second pins on the circuit board is trapezoid.

2. A connector assembly comprising:

a fan connector, the fan connector defining a plurality of receiving holes; and a circuit board connector, the circuit board connector comprising:

a main body configured for electrically connected to a circuit board, the main body defining a plurality of securing holes;

a plurality of first pins, each first pin comprising a first end and a second end opposite to the first end; and a plurality of second pins, each second pin comprising a third end and a fourth end opposite to the third end;

wherein the first ends and the third ends are engaged in the plurality of securing holes for electrically connecting with the circuit board, the second ends and the fourth ends located on the front side of the circuit board, and the second end and the fourth ends are engaged into the plurality of receiving holes of the fan connector;

wherein a shape outlined by the projections of the second ends of the first pins and the fourth ends of the second pins on the circuit board is trapezoid.

* * * * *